United States Patent [19]

Malcolm

[11] Patent Number: 4,721,401

[45] Date of Patent: Jan. 26, 1988

[54] PRINTHEAD CONTROL

[75] Inventor: Jerry W. Malcolm, Austin, Tex.

[73] Assignee: International Business Machines Corporation, Armonk, N.Y.

[21] Appl. No.: 918,431

[22] Filed: Oct. 14, 1986

[51] Int. Cl.[4] ..... B41J 3/12

[52] U.S. Cl. ..... 400/121; 101/93.04; 400/124

[58] Field of Search ..... 400/121, 124, 649, 611, 400/551; 101/93.04, 93.05

[56] References Cited

U.S. PATENT DOCUMENTS 4,037,705 7/1977 Martin ..... 400/124

4,521,123 6/1985 Boehmer ..... 400/121 X

*Primary Examiner*—Paul T. Sewell

*Attorney, Agent, or Firm*—J. H. Barksdale, Jr.; H. St. Julian

[57] ABSTRACT

A method of reducing the need for a reverse indexing capability during multi-pass printing. In environments permitting narrow line spacings, requiring multiple passes to print a line, and where platen indexing is by full head height increments, indexing for completing printing for one line may result in an overshooting of a subsequent print line. Without reverse indexing capabilities, the subsequent line cannot be printed at a proper location or on the subsequent print line. A solution to reduce the occurrence of this problem is to index the platen only to the extent necessary to complete printing of a line on a subsequent pass.

5 Claims, 4 Drawing Figures

PRINTHEAD CONTROL

DESCRIPTION

1. Technical Field

This invention relates generally to multi-pass line printing, and more specifically to controlling printhead positioning during multi-pass printing.

2. Background Art

In the prior art are matrix printers such as the IBM Personal Computer Graphics Printer and the IBM Proprinter having a printhead with a vertical column of 8 print wires or pins. As each wire is fired or activated, a dot will be printed on the paper being printed. Other similar printers may have a different number of print wires. As will be explained in greater detail below, a -common deficiency among many of these printers is the absence of a reverse index feature. Without the feature, the platen is only rotatable in one direction during printing.

With only 8 pins and with many characters being more than 8 dots in height, multiple passes are required for printing larger characters, or characters having a portion extending below one print pass. Consider the lower case "j" in FIG. 1. All but one dot is printed on the first pass. Then the platen is rotated 8 dot positions and the top wire on the printhead is activated or fired for printing the last dot to complete the character. The above is fairly straightforward and no real problems are encountered for printing a single character.

During each printhead pass, all portions of all characters encompassed by the 8 dots will be printed for a given print line. That is, it may only take one printhead pass to print all characters on a print line, or it may take multiple passes to complete some or all of the characters on a print line. This is irrespective of whether some or all of the characters have portions extending above or below a printing base line. A base line is a line, usually imaginary, upon which the majority of characters will sit. A print line will encompass all characters between two carrier returns.

With many printers allowing a line spacing of as little as a fraction of a dot spacing, the absence of a reverse indexing capability can present a major problem. Line spacing is the distance between the top of one line and the top of the next line. Refer next to FIG. 2 for an appreciation of this problem. The lower case "j" exists on one print line and since its dot pattern descends to the ninth row, it will require a second pass of the printhead. If the line spacing is specified to be 4 dot spacings, printing of the next print line at the specified line spacing is impossible without reverse indexing. This is because the platen has already been rotated 8 dots to complete the "j", and this is 4 more dots than the line spacing.

The advance presented by the instant invention is a reduction in the number of instances where the above described problem will be troublesome. The solution to the problem is to index the platen only to the extent sufficient to complete a character or characters on a print line on a subsequent pass or passes of the printhead. The advantages of this advance are that printing with very narrow line spacing is efficiently managed, and the need for reverse indexing capabilities is greatly reduced.

DISCLOSURE OF THE INVENTION

A unique method of managing multi-pass printing in a narrow line spacing environment is provided in order to efficiently handle a wide range of printing desires and reduce the need for expensive reverse indexing capabilities. On any subsequent pass for printing a line, the platen is indexed only to the extent necessary for a printhead to complete the line.

BEST MODE FOR CARRYING OUT THE INVENTION

Figure 3:
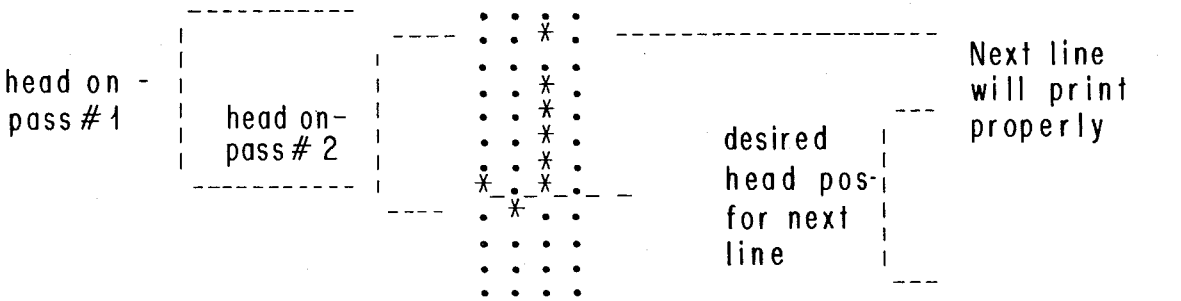
FIG. 3 illustrates platen indexing only to the extent necessary to complete printing of a line.

For a clearer understanding of the invention, reference is next made to FIG. 3.

Figure 1:
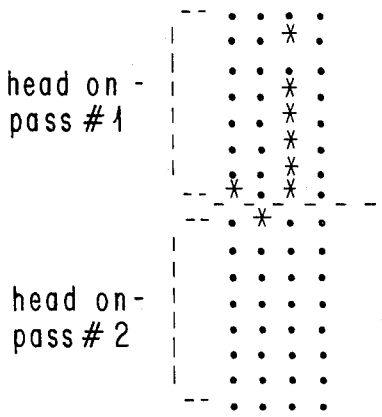
FIG. 1 Prior Art
FIG. 1 illustrates prior art full head height indexing to complete printing of a character on a print line.
Figure 2:
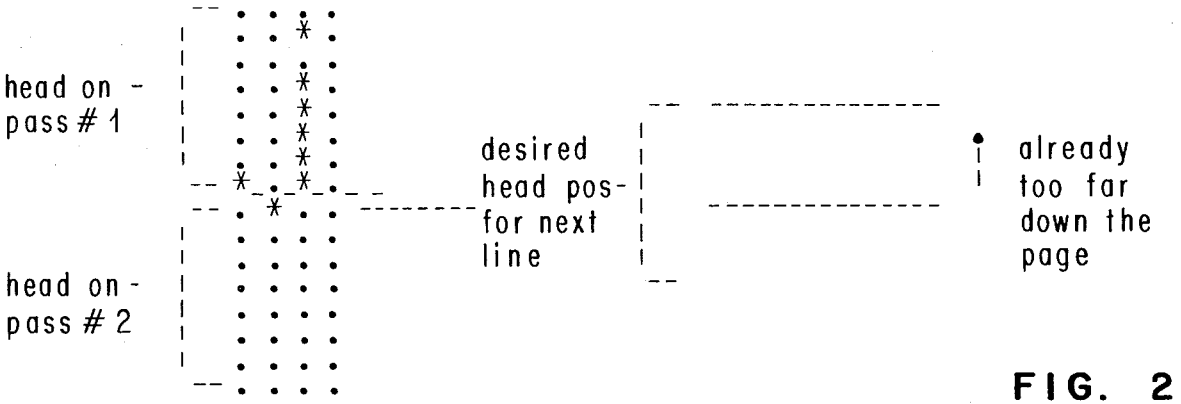
FIG. 2 Prior Art
FIG. 2 illustrates a prior art problem of a subsequent print line being located above a previously indexed position.

On the first or current print pass of the printhead, as with FIG. 1, all but one of the dots for "j" are printed. Then rather than index the platen the height of the head or 8 dots as with the prior art of FIG. 1, the platen is only indexed one dot. With this indexing, there must be a shifting of the dot pattern from the top of the printhead as with FIG. 1, to the bottom of the printhead. Refer to the subsequent pass #2 in FIG. 3. Thereafter, if indexing for the next print line is to be the same as in FIG. 1, this is readily accomplished since there has been no overshooting of the next print line. The indexing increment for completing the "j" on the second pass is subtracted from the specified line spacing, and the platen is indexed the remaining amount. Refer to the head position for the next line in FIG. 3.

By indexing in the above described manner, the chances that the print head will be unable to print the next line at the proper location will be minimized.

Set out below is an illustration of a routine that may be incorporated into a program that is responsible for controlling the printer to the extent of specifying the specific dot placements on the page to create the likeness of a particular character. This routine is in programming design language from which both source code and machine code are derivable.

```
PRINT FIRST PASS ACROSS DATA AND DETERMINE
        TOTAL NUMBER OF VERTICAL DOTS
        REQUIRED FOR LINE
IF NUMBER OF DOTS GREATER THAN 8 THEN DO
    NUMBER OF DOT POSITIONS TO ROTATE
        PLATEN = TOTAL NUMBER OF VERTICAL
        DOTS - 8
    ROTATE PLATEN BY CALCULATED NUMBER OF
    DOTS
    NUMBER OF POSITION TO SHIFT REMAINING
        DOTS = 8 - PLATEN ROTATION AMOUNT
    PRINT SECOND PASS ACROSS DATA SHIFTING
        EACH BYTE OF GRAPHICS DATA BY
        CALCULATED AMOUNT
    ROTATE PLATEN BY LINE SPACING AMOUNT -
        AMOUNT ALREADY ROTATED FOR
```

-continued

```
SECOND PASS
ELSE (NUMBER OF DOTS EQUAL TO OR LESS THAN 8)
    ROTATE PLATEN BY LINE SPACING AMOUNT
ENDIF
```

Figure 4:
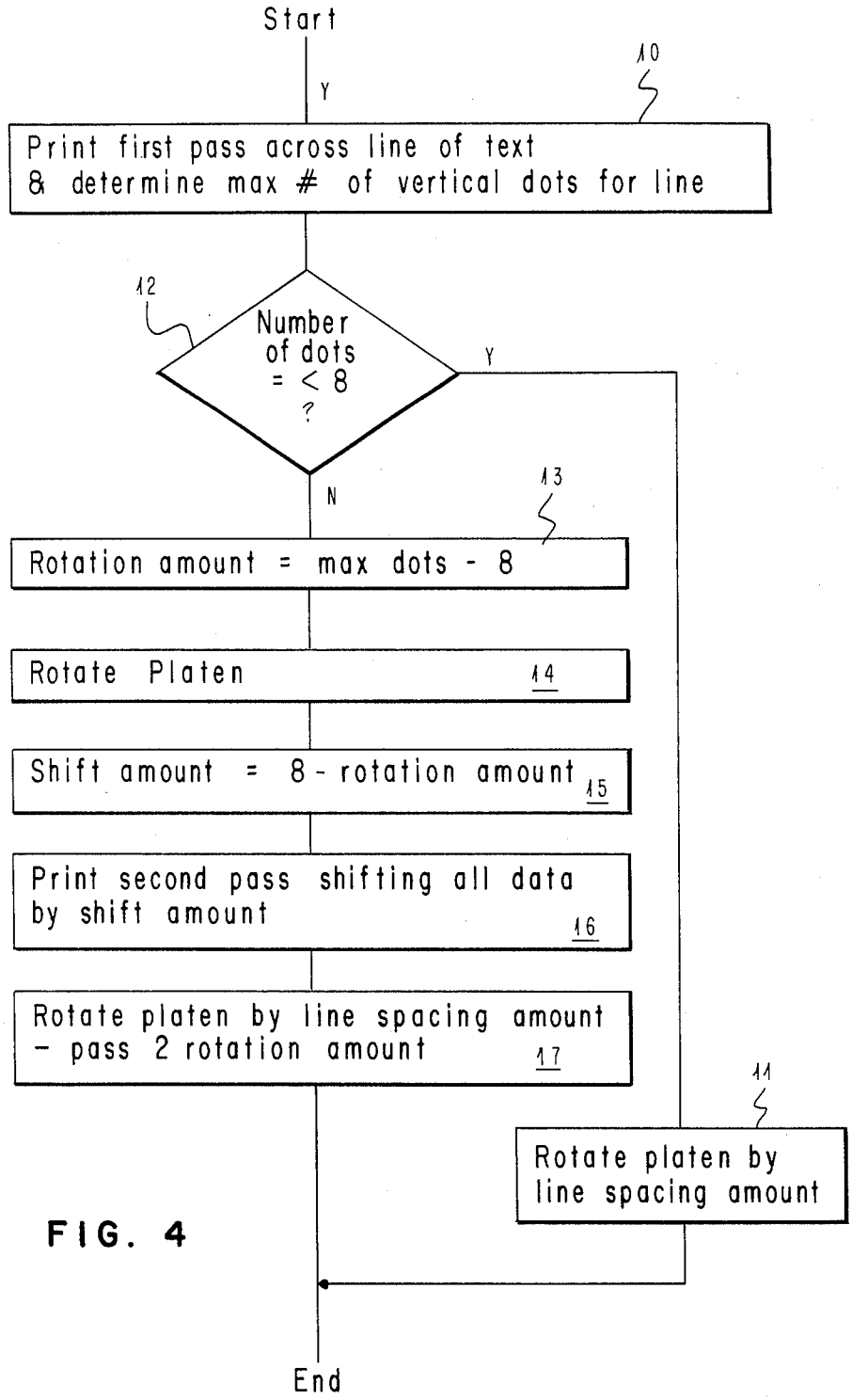
FIG. 4 is a flow chart illustrating the operations performed in causing an indexing in such a manner that a subsequent line can be printed at an appropriate location following indexing for completion of printing of a previous print line.

Refer next to the flow chart of FIG. 4 in conjunction with the above programming design language. Defined are the operations performed by the printer control program to minimize the potential of the printhead not being able to print a subsequent line at an appropriate location.

While the first or current pass is made along a line being printed, a determination is made as to the maximum number of vertical dots for all characters in the line. This determination is indicated by block 10. If the maximum is 8 or less as indicated by block 12, all the data will be printed on one pass. In this case, as indicated by block 11, the platen is rotated by the specified line spacing amount and printing continues for the next print line. If the maximum is more than 8 dots, at least a second printing pass is required. The amount of required platen rotation is calculated by subtracting 8 from the maximum as indicated by block 13. Eight dots are subtracted since 8 dots have already been printed on the first pass. The result is the minimum number of dot positions that the platen must be rotated to print the remaining dots. The platen is then rotated this minimum number of dot positions as indicated by block 14. Then for every column of dots printed on the second pass, the data is shifted to the bottommost pins on the printhead as indicated by block 16. The shift amount is calculated by subtracting the platen rotation amount from 8 as indicated by block 15. Finally, after the line has been printed, the platen is indexed to the proper location to start the next line. The amount of platen indexing is the specified line spacing minus any amount of indexing for a subsequent pass or passes as indicated by block 17.

It is to be appreciated that for full 8 dot subsequent passes, shifting is unnecessary and printing can be handled in a normal manner.

In summary, a unique method of managing multi-pass printing in a narrow line spacing environment is provided in order to efficiently handle a wide range of printing desires and reduce the need for expensive reverse indexing capabilities. On any subsequent pass for printing a line, the platen is indexed only to the extent necessary for a printhead to complete the line.

While the invention has been particularly shown and described with reference to a preferred embodiment, it will be understood by those skilled in the art that various changes in form and detail may be made without departing from the spirit and scope of the invention.

I claim:

1. In a matrix printer printing system wherein multiple printing passes are permitted to complete printing of characters along a print line and platen is indexed for each printing pass, a method of reducing a need for reverse indexing, said method comprising:

scanning a line of characters to determine a maximum number of character bits required to print each of said characters along a print line;

printing said entire characters or portions thereof along said print line during a first pass;

indexing said platen, in response to said scanning step, only to an extent required to complete printing of said line of characters; and selectively printing remaining portions of said characters along said print line during a subsequent pass when said maximum number of character bits exceeds a predetermined number of character bits.

2. A method according to claim 1 including indexing said platen by a specified line spacing amount upon completion of printing of said line.

3. A method according to claim 1 including shifting character bits to be printed as dots from the top of a printhead to the bottom of said printhead upon the indexing of said platen only an extend required to complete printing of said line if said platen is indexed less than the height of said printhead.

4. A method according to claim 2 including indexing said platen for a subsequent print line by an amount equal to said specified line spacing minus an amount of indexing required to print on a subsequent print pass.

5. A method according to claim 4 including subtracting indexing for all subsequent passes to complete a line from said specified line spacing to determining an extent of indexing for printing a subsequent print line.

* * * * *

UNITED STATES PATENT AND TRADEMARK OFFICE

CERTIFICATE OF CORRECTION

PATENT NO. : 4,721,401

DATED : January 26, 1988

INVENTOR(S) : J. W. Malcolm

It is certified that error appears in the above-identified patent and that said Letters Patent is hereby corrected as shown below:

Col. 4, Line 34, delete "extend" and insert --extent--.

Signed and Sealed this

Twentieth Day of August, 1991

*Attest:*

HARRY F. MANBECK, JR.

*Attesting Officer*

*Commissioner of Patents and Trademarks*